US012716248B2

(12) United States Patent
Steinwandel

(10) Patent No.: US 12,716,248 B2
(45) Date of Patent: Aug. 25, 2026

(54) METHOD AND SYSTEM FOR CONTROLLING A MOVEMENT OF AN ADJUSTABLE DISTRIBUTOR BOOM, AND METHOD FOR DISTRIBUTING CONSTRUCTION MATERIAL AND/OR THICK MATTER BY MEANS OF A CONSTRUCTION MATERIAL AND/OR THICK MATTER PUMPING DEVICE HAVING AN ADJUSTABLE DISTRIBUTOR BOOM

(71) Applicant: Putzmeister Engineering GmbH, Aichtal (DE)

(72) Inventor: Alexander Steinwandel, Reutlingen (DE)

(73) Assignee: Putzmeister Engineering GmbH, Aichtal (DE)

( * ) Notice: Subject to any disclaimer, the term of this patent is extended or adjusted under 35 U.S.C. 154(b) by 39 days.

(21) Appl. No.: 18/576,826

(22) PCT Filed: Jun. 29, 2022

(86) PCT No.: PCT/EP2022/067906
§ 371 (c)(1),
(2) Date: Jan. 5, 2024

(87) PCT Pub. No.: WO2023/280656
PCT Pub. Date: Jan. 12, 2023

(65) Prior Publication Data

US 2024/0337118 A1 Oct. 10, 2024

(30) Foreign Application Priority Data

Jul. 6, 2021 (DE) ..... 10 2021 207 097.3

(51) Int. Cl.
*E04G 21/04* (2006.01)

(52) U.S. Cl.
CPC ..... *E04G 21/0463* (2013.01); *E04G 21/0436* (2013.01)

(58) Field of Classification Search
CPC ..... E04G 21/0463; E04G 21/0436; B25J 9/1635; B25J 9/162; G05B 2219/45086; B66C 23/68
See application file for complete search history.

(56) References Cited

U.S. PATENT DOCUMENTS 8,406,989 B1 * 3/2013 Bhattacharyya ..... B25J 9/1666 703/2
2008/0053945 A1 3/2008 Schneider et al.
(Continued)

FOREIGN PATENT DOCUMENTS

CN 111168675 A 5/2020
CN 112677149 A 4/2021
(Continued)

OTHER PUBLICATIONS

International Search Report (PCT/ISA/210) issued in PCT Application No. PCT/EP2022/067906 dated Oct. 7, 2022 with English translation (5 pages).
(Continued)

*Primary Examiner* — Adam R Mott
*Assistant Examiner* — Matthew C Gammon
(74) *Attorney, Agent, or Firm* — Crowell & Moring LLP

(57) ABSTRACT

A method controls movement of an adjustable distributor boom having a plurality of adjustable boom components, wherein at least one same tip position of a boom tip of the distributor boom can be achieved by way of different position combinations of the boom components. The method has the steps of: a) determining vectorial distance variables for a plurality of boom elements of the distributor boom in relation to at least one obstacle for the boom elements, b)
(Continued)

determining vectorial evasive movement variables for a plurality of the boom components based on the determined distance variables, and c) controlling the movement based on the determined evasive movement variables and a vectorial operator movement variable determining a tip position.

8 Claims, 4 Drawing Sheets

(56) References Cited

U.S. PATENT DOCUMENTS

| | | | | |
|---|---|---|---|---|
| 2020/0254610 | A1* | 8/2020 | Maier | B25J 9/1605 |
| 2020/0392746 | A1* | 12/2020 | Bertram | B25J 9/1689 |
| 2020/0392747 | A1 | 12/2020 | Henikl et al. | |

FOREIGN PATENT DOCUMENTS

| | | | | |
|---|---|---|---|---|
| DE | 10 2016 125 145 | A1 | 6/2018 | |
| DE | 10 2019 105 817 | A1 | 9/2020 | |
| EP | 3705663 | A1 * | 9/2020 | E04G 21/0463 |
| JP | 2006-45898 | A | 2/2006 | |
| JP | 2008-56492 | A | 3/2008 | |

OTHER PUBLICATIONS

German-language Written Opinion (PCT/ISA/237) issued in PCT Application No. PCT/EP2022/067906 dated Oct. 7, 2022 with English translation (9 pages).

Chinese-language Office Action issued in Chinese Application No. 202280049049.9 dated Dec. 29, 2025 with English translation (18 pages).

Japanese-language Office Action issued in Japanese Application No. 2024-500266 dated Sep. 9, 2025 with English translation (10 pages).

* cited by examiner

METHOD AND SYSTEM FOR CONTROLLING A MOVEMENT OF AN ADJUSTABLE DISTRIBUTOR BOOM, AND METHOD FOR DISTRIBUTING CONSTRUCTION MATERIAL AND/OR THICK MATTER BY MEANS OF A CONSTRUCTION MATERIAL AND/OR THICK MATTER PUMPING DEVICE HAVING AN ADJUSTABLE DISTRIBUTOR BOOM

FIELD OF APPLICATION

The invention relates to a method and to a system, each in particular for controlling a movement of an adjustable distributor boom, and to a method for distributing construction material and/or thick matter by means of a construction material and/or thick matter pumping device having such an adjustable distributor boom and being able to carry out the method.

BACKGROUND AND SUMMARY

The invention is based on providing a method and a system, each in particular for controlling a movement of an adjustable distributor boom and each having improved characteristics, and a method for distributing construction material and/or thick matter by means of a construction material and/or thick matter pumping device having an adjustable distributor boom with such a method for controlling a movement of an adjustable distributor boom.

The invention achieves this object by providing methods and a system having the features of the independent claims. Advantageous refinements and/or design embodiments of the invention are described in the dependent claims.

The, in particular automatic, method according to the invention is designed or configured or provided, respectively, to control, in particular automatically, a movement or a travel or an adjustment, respectively, of an, in particular flexibly, adjustable distributor boom. The distributor boom comprises, or has, a plurality of, in particular flexibly, adjustable boom components. At least one same tip position, in particular a same value of the tip position, of a boom tip of the distributor boom is achievable by different position combinations or configurations, respectively, in particular different values of the position combination, of the boom components. The method comprises, for example the following steps: a) identifying, in particular automatically identifying and/or detecting and/or calculating of, in particular respective and/or a plurality of, vectorial distance variables, in particular values of the distance variables and/or, in particular geometric, distance vectors, for a plurality of boom elements, in particular of the plurality of boom elements, of the distributor boom in relation to at least one, in particular each and/or respective, in particular next, obstacle, in particular in relation to at least the obstacle, for the boom elements; b) identifying, in particular automatically identifying and/or calculating of, in particular respective, vectorial evasive movement variables, in particular values of the evasive movement variables, and/or, in particular geometric, evasive movement vectors, for a plurality of, in particular all, boom components based on the identified distance variables; c) controlling, in particular automatically controlling, the movement as a function of the identified evasive movement variables and a vectorial operator movement variable, in particular at least one value of the operator movement variable and/or of an, in particular geometric, operator movement vector, determining a tip position, in particular a value of the tip position, in particular of the boom tip.

This enables the distributor boom to, in particular actively, evade at least the obstacle during or, in particular simultaneously, with the movement or travel of the distributor boom, in particular so as to achieve the, in particular determined, tip position. In this way, this avoids blocking or stopping the, in particular further, movement of the distributor boom, in particular so as to avoid, in particular imminent or looming, contact, or a collision, between the distributor boom and at least the obstacle. In this way, this makes it possible to reach the, in particular determined, tip position.

In this way, this in particular makes possible a safe operation, in particular monitored operation, without unnecessary interruptions of the work. In this way, this enables an enhancement in terms of an acceptance of a, in particular the, monitored operation and thus of its frequent use. In this way, this makes it possible to improve safety during the movement, or an operation, of the distributor boom. Additionally or alternatively, this, in particular the evasive action, enables the smooth operation of the distributor boom, in particular with single-handed operation in a tight working environment. In this way, this makes possible a significant simplification in terms of operating the distributor boom, in particular for inexperienced operators or users, and thus an increase in productivity, on the one hand, and improved safety by focusing attention on the boom tip, on the other hand.

The term "self-acting" may in particular be used synonymously with the term "automatic".

The distributor boom can be a construction material and/or thick matter distributor boom. Additionally or alternatively, the distributor boom can be a construction material and/or thick matter pumping device. The construction material and/or thick matter pumping device can in particular be mobile, in particular drivable, in particular a vehicle-mounted construction material and/or thick matter pump. Furthermore additionally or alternatively, the construction material and/or thick matter pumping device can be configured to convey construction material and/or thick matter. Furthermore additionally or alternatively, construction material can refer to mortar, cement, screed, concrete and/or render. Furthermore additionally or alternatively, thick matter can refer to mud.

At least the same tip position of the boom tip can be achievable by at least three, in particular at least ten, different position combinations of the boom components.

A plurality of, in particular at least three, in particular at least ten, tip positions of the boom tip can be achievable, in particular at different points in time, by way of, in particular respective, different position combinations of the boom components.

The boom tip can be a free end of the distributor boom.

The distributor boom can have one, in particular freely suspended, end hose, in particular as one of the plurality of boom elements.

The boom elements can comprise, in particular be, the boom components, and/or the boom components can comprise, in particular be, the boom elements.

The term "movement limit" or the term "interference contour" or the term "obstacle landscape" may be used synonymously with the term "obstacle".

The obstacle can be dynamic and/or be another distributor boom.

The distance variables can be, in particular momentary or current, actual distance variables, and/or for the plurality of boom elements of the distributor boom be in an, in particular momentary or current, actual boom position or pose, respectively. The actual boom position can in particular be able to be changed by the, in particular variable, position combination. Additionally or alternatively, the distance variables can be, in particular momentary or current, directions, in particular actual directions, and/or, in particular momentary or current, values, in particular actual values, of distances of the boom elements in relation to at least the obstacle.

The evasive movement variables can be, in particular momentary or current, target evasive movement variables. Additionally or alternatively, the evasive movement variables can be, in particular momentary or current, directions, in particular target directions, and/or, in particular momentary or current, speeds, in particular target speeds, of, in particular respective and/or a plurality of, evasive movements, in particular target evasive movements, of the plurality of boom components.

The operator movement variable determining the tip position can be an, in particular momentary or current, target operator movement variable, and/or determining an, in particular momentary or current, target tip position, in particular of the boom tip. Additionally or alternatively, the operator movement variable can be an, in particular momentary or current, direction, in particular a target direction, and/or an, in particular momentary or current, speed, in particular a target speed, of a movement, in particular of a target movement, of the boom tip. Furthermore additionally or alternatively, the operator movement variable can be an, in particular momentary or current, travel command or travel order, in particular to achieve the tip position. Furthermore additionally or alternatively, the operator movement variable can be predefined, in particular momentarily or currently, respectively, in particular by the operator or user, respectively, in particular of the distributor boom and/or of the construction material and/or thick matter pumping device. Furthermore additionally or alternatively, the method can comprise the step: identifying, in particular detecting, an, in particular momentary or current, parameter of the operator movement variable, in particular by the operator.

Should the operator movement variable not be predefined, or not be present and/or equal zero, step c) does not need to be or cannot be carried out or no movement of the distributor boom needs to be or can be controlled.

Step c) can comprise: controlling the movement by mutually linking or combining or superimposing, respectively, the evasive movement variables and the operator movement variable, in particular by means of a kinematic correlation.

Step b) can be carried out after step a) in temporal terms. Additionally or alternatively, step c) can be carried out after step b) in temporal terms. Furthermore additionally or alternatively, the method, in particular steps a), b) and c), can be carried out, in particular anew, in particular multiple times.

In a refinement of the invention, the boom components are of identical type, in particular ends of boom segments or portions of the distributor boom, in particular the boom tip, and, in particular flexibly, adjustable boom joints, in particular intermediate boom joints, of the distributor boom. In particular, at least one of the boom joints can have, in particular be, an articulated joint, rotary joint and/or thrust joint. A last boom joint can in particular be rotatable about a vertical axis. Additionally or alternatively, the construction material and/or thick matter pumping device, in particular the distributor boom, can have a plurality of joint drives for moving or adjusting the boom joints.

In a refinement of the invention, the vectorial evasive movement variables point, or lead, away from the, in particular respective, obstacle. In particular, the vectorial evasive movement variables are counter to the, in particular respective, vectorial distance variables. This enables at least one of the boom components to be moved, or adjusted, away from the obstacle and/or at least one of the distance variables to be enlarged, in particular in this way.

In a refinement of the invention, step c) comprises: controlling the movement by means of, in particular automatically, weighting the evasive movement variables, in particular by means of, in particular respective variable, weighting factors, in particular values of the weighting factors, independently of, or based on, in particular respective, values of the distance variables, in particular and of the operator movement variable. This enables an urgent evasion of one of the boom components, in particular for avoiding contact, to be given precedence or priority relative to a less or not urgent evasion or a movement of another boom component. In particular, the weighting factors can be reciprocal depending on the values of the distance variables. Additionally or alternatively, a weighting factor of the operator movement variable can in particular be temporally permanent, fixed or constant. Furthermore additionally or alternatively, this, in particular the weighting, may lead to the evasive movement variables and the operator moving variable not being mutually compatible, in particular to the evasive movement variables outweighing the operator movement variable. This can thus lead to no movement of the distributor boom having to be controlled, or being able to be controlled.

In a refinement, in particular a design embodiment, of the invention, the method comprises or includes in particular the step: memorizing, in particular automatically memorizing, the controlled or performed movement of the distributor boom. The method comprises or includes the step: should the evasive movement variables and the operator moving variable not be mutually compatible, in particular the evasive movement variable outweigh the operator movement variable, carrying out, in particular automatically, the memorized movement in reverse, or carrying out said movement in reverse, in particular in temporal terms. This allows a way out of this situation and/or, in particular consequently the reaching of the, in particular determined, tip position, in particular in another way.

In a refinement of the invention, the method comprises or includes the step: modeling, in particular automatically modeling, the obstacle, in particular of a remaining part of a, in particular the, construction material and/or thick matter pumping device having the distributor boom, with a shape larger than a real or actual shape of the obstacle, in particular by means of, in particular automatically, smoothing and/or flattening transitions of the real shape. Step a) comprises: identifying at least one, in particular all, of the distance variables, in particular at least for the boom tip, in relation to the modeled obstacle. This makes it possible to avoid that the evasive movement variables and the operator movement variable not mutually compatible. The modeling can in particular comprise an introduction of flanks and/or ramps. Additionally or alternatively, the smoothing and/or the flattening of the transitions may comprise, in particular be, the radiusing of edges and/or corners.

In a refinement of the invention, the distributor boom comprises or has a plurality of in particular flexibly adjustable, in particular the plurality of adjustable, boom joints. In particular at least the same tip position is achievable by different joint position combinations of the boom joints. In particular, the boom joints have or include different adjustment ranges, in particular different values in terms of the adjustment ranges. Step c) comprises: controlling movements of the boom joints as a function of the evasive movement variables and the operator movement variable, in particular and while taking into account the adjustment ranges. In particular, at least one of the boom joints can have, in particular be, an articulated joint, rotary joint and/or thrust joint. In particular, a last boom joint can be rotatable about a vertical axis. Additionally or alternatively, at least one of the adjustment ranges can have, in particular be, an angular range. Furthermore additionally or alternatively, at least one of the adjustment ranges can be defined, in particular delimited, by at least one, in particular mechanical, detent of at least one of the boom joints. Furthermore additionally or alternatively, the construction material and/or thick matter pumping device, in particular the distributor boom, can have a plurality of joint drives for moving or adjusting the boom joints, or for changing or adjusting the, in particular variable, joint position combination. Furthermore additionally or alternatively, one of the boom joints can be on a non-free or fixed end, or a boom foot of the distributor boom. Furthermore additionally or alternatively, the distributor boom can be foldable in a rolling and/or Z-shaped manner, in particular in a rolling/Z-shaped manner, by means of the boom joints.

In a refinement, in particular a design embodiment, of the invention, step c) comprises: controlling the movement by means of, in particular weighted and/or modular, inverse kinematics. The evasive movement variables and the operator movement variable herein are input variables. This enables the distributor boom to avoid at least the obstacle, in particular simultaneously, with the movement or travel of the distributor boom, in particular for achieving the, in particular determined, tip position. In other words: this enables the simultaneous implementation of the, in particular ordered, travel command, and the avoidance of contact. In yet again other words: this enables the avoidance of contact, or the avoidance of collision, to be embedded in an implementation of the travel command, in particular by the operator. In particular, the boom tip can be referred to as the end effector, or tool center point (TCP). Additionally or alternatively, the term "inverse kinematics" or the term "reverse transformation" can be used synonymously with the term "inverse kinematics". Furthermore additionally or alternatively, the inverse kinematics can take into account, in particular comprise, the adjustment ranges. Furthermore additionally or alternatively, speeds, in particular rotating speeds or joint speeds, of the boom components, in particular of the boom joints, can be output variables. Furthermore additionally or alternatively, the output variables can be, in particular automatically, identified, in particular scanned and/or calculated.

In particular, the obstacle, in particular at least one value of the obstacle, can be predefined or have been predefined, in particular detected or measured, in particular by the operator and/or a construction program. Additionally or alternatively, step a) can comprise: identifying, in particular calculating, the distance variables based on the predefined, in particular detected, obstacle and the actual boom position of the distributor boom. In particular, the actual boom position can be or have been, in particular automatically, identified, in particular calculated, by means of direct kinematics, in particular wherein an, in particular momentary or current, actual position combination, in particular at least one value of the actual position combination, of the boom components can be an input variable. Joint angles of the boom joints can in particular be input variables.

In a refinement of the invention, step a) comprises: contactless detecting or measuring, in particular automatic detecting, of the obstacle and/or the distance variables, in particular during or in the movement, in particular simultaneously with the latter. This enables the avoidance of contact. The detection can in particular take place by means of a camera and/or LIDAR (light detection and ranging), in particular LADAR (laser detection and ranging).

The in particular automatic method according to the invention is configured or designed or provided to, in particular automatically, distribute construction material and/or thick matter by means of a, in particular the, construction material and/or thick matter pumping device. The construction material and/or thick matter pumping device has a, in particular the, adjustable distributor boom. The distributor boom comprises or has an in particular flexibly adjustable conveying line for conveying, or for conveying construction material and/or thick matter. The method comprises or has a, in particular the, method for controlling a, in particular the, movement of the distributor boom as mentioned or described above. The method comprises or has the step: conveying, in particular automatically conveying, construction material and/or thick matter during or in the movement or step c), in particular simultaneously with the latter, in particular by means of, or through, the conveying line. This, in particular the conveying during the movement, enables the distribution. The conveying line can in particular have, in particular be, a pipeline. Additionally or alternatively, the conveying line can comprise the end hose.

The system according to the invention is configured or designed to control, in particular to control, a, in particular the, movement of an, in particular the, adjustable distributor boom. The distributor boom has a plurality of adjustable, in particular the plurality of adjustable, boom components. At least one same, in particular the same, tip position of a, in particular the, boom tip of the distributor boom is achievable by different, in particular the different, position combinations of the boom components. The system comprises or has an identification and control installation. The identification and control installation is configured or designed to identify, in particular to identify, in particular the, vectorial distance variables for a plurality of, in particular the plurality of, boom elements of the distributor boom in relation to at least one, in particular the, obstacle for the boom elements. The identification and control installation is configured or designed to identify, in particular to identify, in particular the, vectorial evasive movement variables for a plurality of, in particular the plurality of, boom components based on the determined distance variables. The identification and control installation is configured or designed to control, in particular to control, the movement as a function of the determined evasive movement variables and a, in particular the, vectorial operator movement variable determining a, in particular the, tip position. The system can enable the same advantages as the method/methods mentioned or described above. In particular, the system, in particular the identification and control installation, can be configured or designed to, in particular automatically, carry out a/one of, in particular the, method/methods mentioned above. Additionally or alternatively, the system can comprise the distributor boom, in particular the construction material and/or thick matter pumping device. Furthermore additionally or alternatively, the identification and control installation can be electric, hydraulic and/or pneumatic. In particular, the identification and control installation can comprise a computer unit, in particular a processor, and/or a storage unit.

Further advantages and aspects of the invention are derived from the claims and from the description hereunder of preferred exemplary embodiments of the invention, which are explained hereunder with reference to the figures.

DETAILED DESCRIPTION OF THE DRAWINGS

Figure 1:
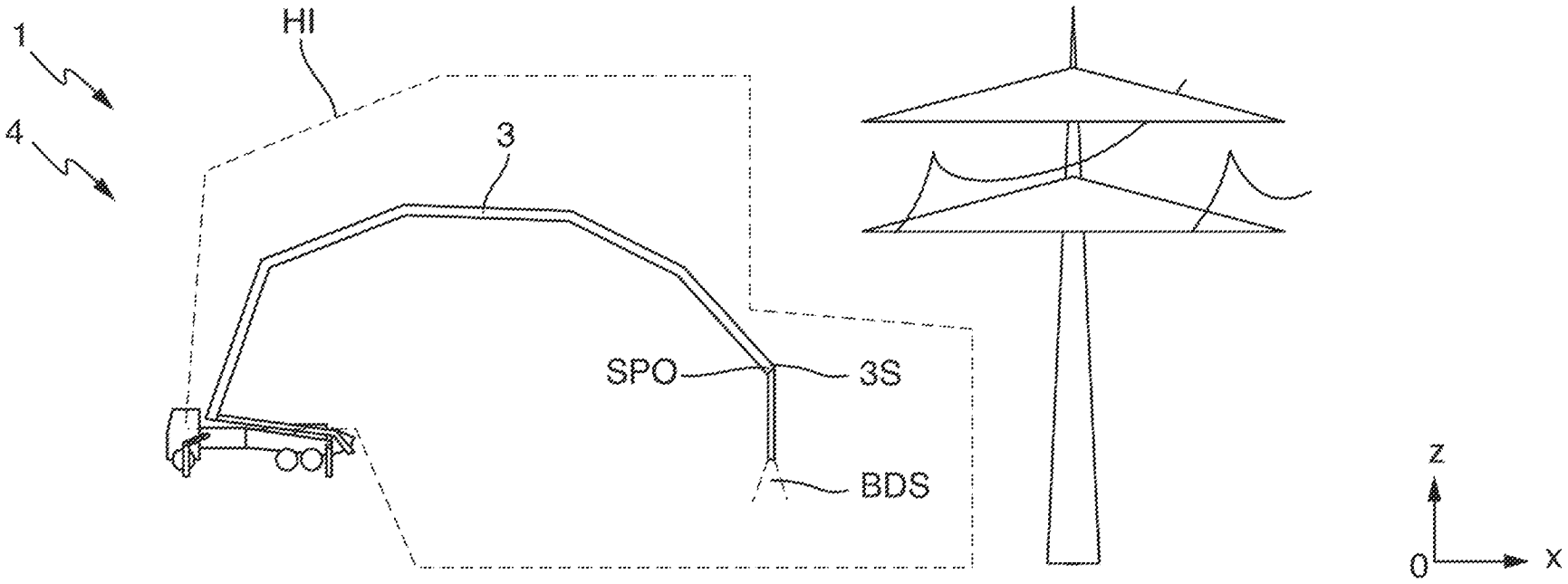
FIG. 1 schematically shows a system and a method according to an embodiment of the invention for controlling movement of an adjustable distributor boom, and a method for distributing construction material and/or thick matter by means of a construction material and/or thick matter pumping device having the adjustable distributor boom and having the method for controlling the movement of the adjustable distributor boom.
Figure 2:
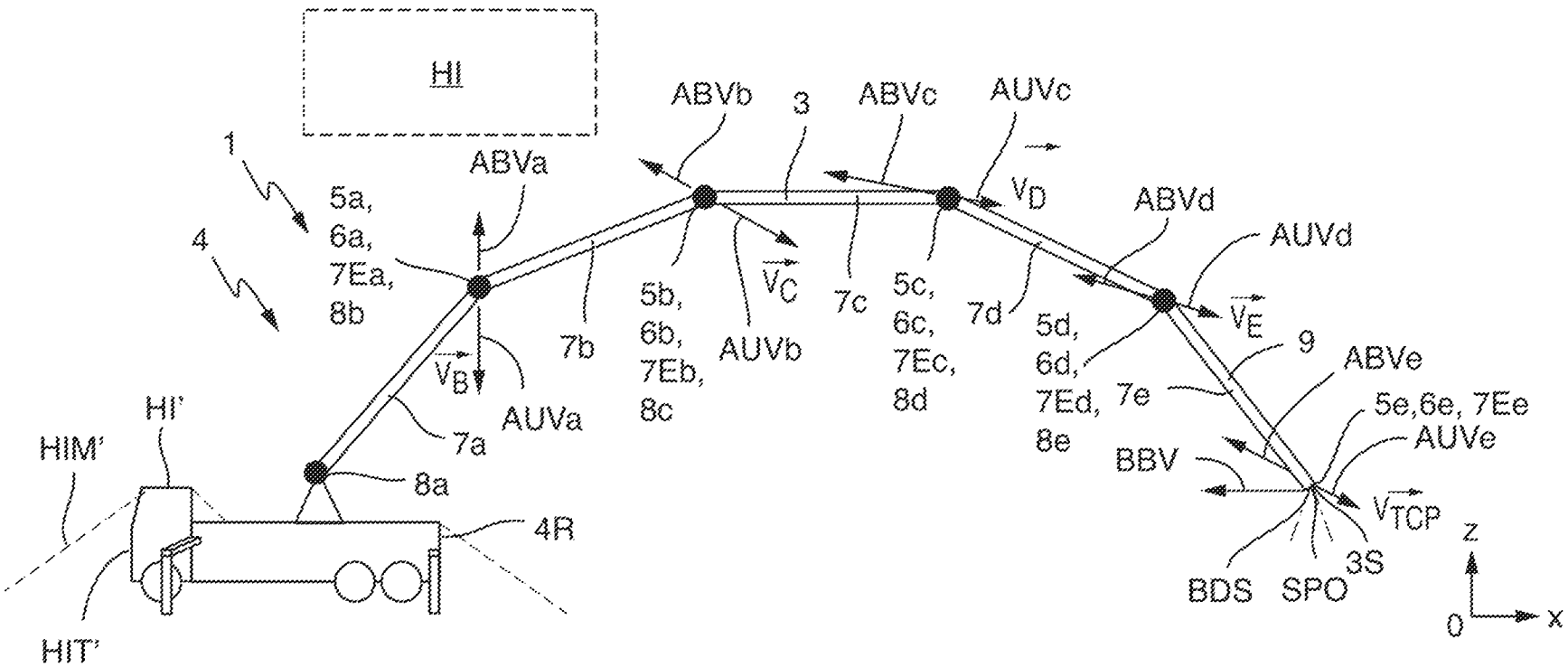
FIG. 2 schematically shows the system and the methods of FIG. 1.
Figure 3:
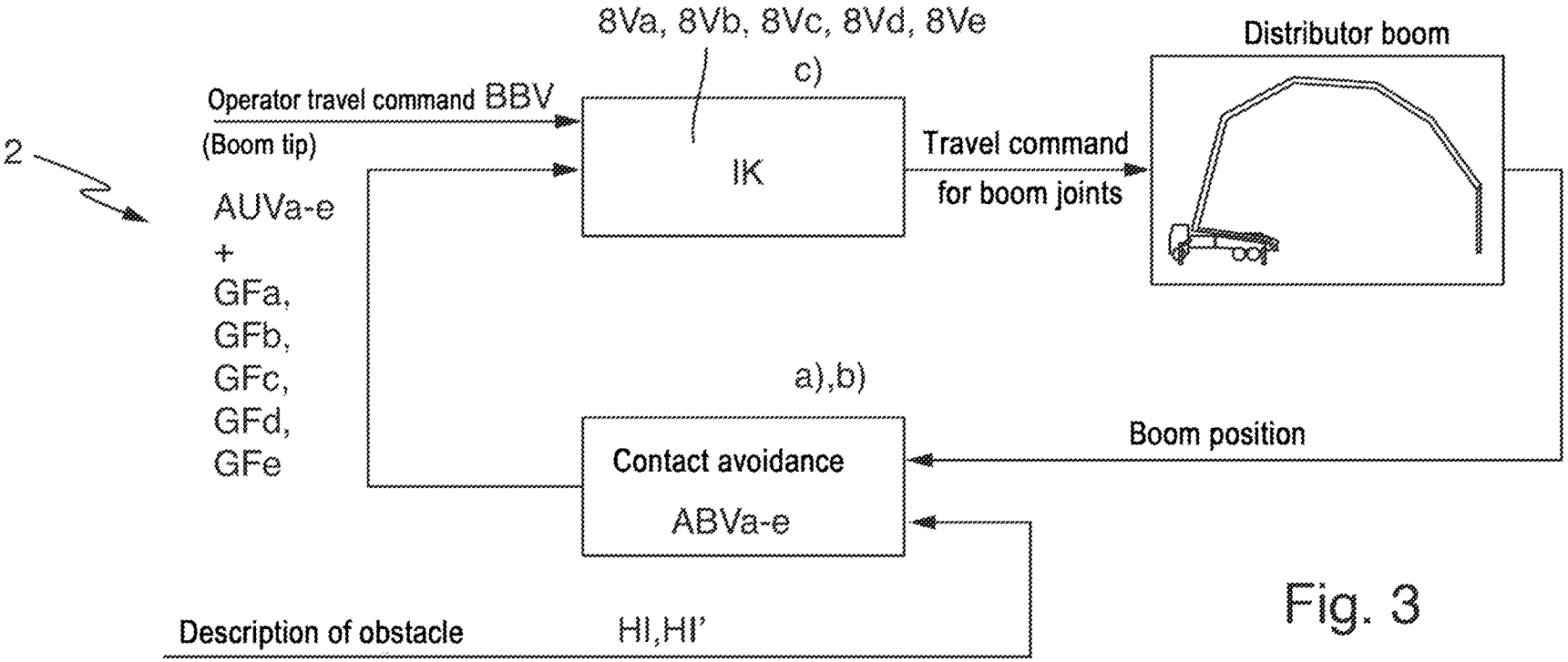
FIG. 3 schematically shows a block diagram of the system and method of FIG. 1.

FIGS. 1 to 4 show a system 1, in particular configured having an identification and control installation 2, and a method, for controlling a movement of an adjustable distributor boom 3. The distributor boom 3 has a plurality of adjustable boom components 5*a*, 5*b*, 5*c*, 5*d*, 5*e*. At least one same tip position SPO of a boom tip 3S of the distributor boom 3 is achievable by different position combinations SK, SK' of the boom components 5*a-e*.

Furthermore, the system 1, in particular the identification and control installation 2, is configured, in particular identified, for identifying vectorial distance variables ABVa, ABVb, ABVc, ABVd, ABVe for a plurality of boom elements 6*a*, 6*b*, 6*c*, 6*d*, 6*e* of the distributor boom 3 in relation to at least one obstacle HI, HI' for the boom elements 6*a-e*. Moreover, the system 1, in particular the identification and control installation 2, is configured, in particular identified, for identifying vectorial evasive movement variables AUVa, AUVv, AUVc, AUVd, AUVe for a plurality of the boom components 5*a-e* based on the identified distance variables ABVa-e. Furthermore, the system 1, in particular the identification and control installation 2, is configured, in particular controlled, to control the movement as a function of the identified evasive movement variables AUVa-e and a vectorial operator movement variable BBV determining a tip position SPO.

Moreover, the method comprises the following steps: a) identifying the vectorial distance variables ABVa-e for the plurality of boom elements 6*a-e* of the distributor boom 3 in relation to the obstacle HI, HI' for the boom elements 6*a-e*, in particular by means of the system 1, in particular the identification and control installation 2; b) identifying the vectorial evasive movement variables AUVa-e for the plurality of the boom components 5*a-e* based on the identified distance variables ABVa-e, in particular by means of the system 1, in particular the identification and control installation 2; c) controlling the movement as a function of the identified evasive movement variables AUVa-e and the vectorial operator movement variable BBV determining the tip position SPO, in particular by means of the system 1, in particular the identification and control installation 2.

In the exemplary embodiment shown, the system 1 comprises the distributor boom 3, in particular a construction material and/or thick matter pumping device 4 having the distributor boom 3.

In terms of their details, the boom components 5*a-e*, in particular ends 7Ea, 7Eb, 7Ec, 7Ed, 7Ee of boom segments 7*a*, 7*b*, 7*c*, 7*d*, 7*e* of the distributor boom 3, in particular the boom tip 3S and adjustable boom joints 8*b*, 8*c*, 8*d*, 8*e* of the distributor boom 3, are of identical type.

Furthermore, the distributor boom 3 has a plurality of adjustable, in particular the plurality of adjustable, boom joints 8*a*, 8*b*, 8*c*, 8*d*, 8*e*. The same tip position SPO is achievable by different joint position combinations GSK, GSK' of the boom joints 8*a-e*. In particular, the boom joints 8*a*, 8*b*, 8*c*, 8*d*, 8*e* have different adjustment ranges 8Va, 8Vb, 8Vc, 8Vd, 8Ve. Step c) comprises: controlling movements of the boom joints 8*a-e* as a function of the evasive movement variables AUVa-e and the operator movement variable BBV, in particular and while taking into account of the adjustment ranges 8Va-e, in particular by means of the system 1, in particular the identification and control installation 2.

In the exemplary embodiment shown, the distributor boom 3 has five adjustable boom components 5*a-e*, or five boom segments 7*a-e*, or five adjustable boom joints 8*a-e*, respectively. In alternative exemplary embodiments, the distributor boom can have at least three boom components, or at least three boom segments, or at least three boom joints, respectively.

To provide background: a boom component, or a boom segment, or a boom joint, respectively, enables a movement of the boom tip. Two boom components, or two boom segments, or two boom joints, respectively, enable free movement of the boom tip, in particular wherein height and radius are mutually independent, in particular within certain limits. At least three boom components, or at least three boom segments, or at least three boom joints, respectively, enable free movement of the boom tip and an adjustment or variation of the joint position combination, or an adjustment of a boom position of the distributor boom by way of at least one degree of freedom. In other words: N boom components, or N boom segments, or N boom joints, where N>=3, enable free movement of the boom tip and an adjustment or variation of the joint position combination, or an adjustment of the boom position, by way of N-2 degrees of freedom.

Moreover, in the exemplary embodiment shown, a plurality of the boom components 5*a-e* corresponds, or is equal, to a plurality of the boom elements 6*a-e*. In alternative exemplary embodiments the plurality of the boom elements can be at least equal to, in particular greater than, the plurality of the boom components.

Furthermore, the vectorial evasive movement variables AUVa-e lead away from the, in particular respective, obstacle HI. In particular, the vectorial evasive movement variables AUVa-e are counter to the, in particular respective, vectorial distance variables ABVa-e.

To provide background: identifying, in particular calculating, the distance variables of the boom elements from at least the obstacle. Generally, these are the distance variables of specific points on the distributor boom in relation to edges and/or surfaces of the obstacle and the distance variables of specific edges and/or surfaces of the distributor boom in relation to corner points of the obstacle. The object of the evasion is maintaining the distance variables of these points (i.e. avoiding that values of the distance variables drop to zero) from at least the obstacle. In order for the values of these vectorial distance variables to be increased with maximum efficiency, the points, in particular reference points, have to move counter to these vectors. The vectorial evasive movement variables, in particular evasive speeds, $\overrightarrow{AUVa,v_B}$ to $\overrightarrow{AUVe,v_{TCP}}$ thus have to be counter to the vectorial distance variables $\overrightarrow{ABVa,d_B}$ to $\overrightarrow{ABVe,d_{TCP}}$, which leads to the formula:

$$\vec{v}_{X,A} = v_{A,X} \cdot \vec{e}_{d,X}$$

with the unit vector counter to $\vec{d}_x$ $$\vec{e}_{d,X} = -\frac{\vec{d}_X}{\|\vec{d}_X\|_2}$$

The value of the evasive movement variable, in particular evasive speed, $v_{A,X}$ must be positive and is determined as a function of the value of the vectorial distance variable $\|\vec{d}_x\|_2$ in such a way that said value of the evasive movement variable increases when the value of the vectorial distance variable decreases. Therefore, a potential simple correlation would be:

$$v_A = \frac{1}{\|\vec{d}_X\|_2}$$

Moreover, step c) comprises: controlling the movement by means of weighting the evasive movement variables AUVa-e, in particular by means of, in particular respective variable, weighting factors GFa, GFb, GFc, GFd, GFe, depending on, in particular respective, values of the distance variables ABVa-e, in particular the operator movement variable BBV, in particular by means of the system 1, in particular the identification and control installation 2.

To provide background: in addition to the evasive movement variables, in particular the evasive speeds, a weight $GF,w_{A,X}$ is also identified, in particular calculated, for each distance variable, or each evasive movement variable, which describes the urgency of the evasive movement. The requirements pertaining to the weight are similar to those pertaining to the value of the evasive movement variable, in particular the evasive speed, $v_{A,X}$. The separation into the value of the evasive movement variable, in particular the evasive speed, on the one hand, and the weight, on the other hand, makes it possible that even small required evasive movement variables, in particular evasive speeds, can be implemented with great urgency. In particular, the extent of the required evasive movement variable, in particular of the required evasive speed, can be limited in this way without the respective movement pertaining to the consideration suffering in the subsequent identification of required joint speeds.

Furthermore, step c) comprises: controlling the movement by means of, in particular weighted and/or modular, inverse kinematics IK, in particular by means of the system 1, in particular the identification and control installation 2. The evasive movement variables AUVa-e and the operator movement variable BBV herein are input variables.

To provide background: in order to identify a travel command for the boom joints from the identified, in particular determined, evasive movement variables, in particular evasive speeds, and their weights, the kinematic correlation between the temporal change of joint angles $\varphi_1$ to $\varphi_N$ of the boom joints is combined in the vector $\vec{\omega}$:

$$\vec{\omega} = \begin{pmatrix} \omega_1 \\ \vdots \\ \omega_N \end{pmatrix} = \begin{pmatrix} \dot{\varphi}_1 \\ \vdots \\ \dot{\varphi}_N \end{pmatrix}$$

and used for varying the vectorial distance variables $\dot{\vec{d}}_x$. In terms of the distance variables between the edges or surfaces of the obstacle and the reference points on the distributor boom, this variation is defined by the movement of the reference points on the distributor boom. In terms of the distance variables between the determined edges and/or surfaces of the distributor boom and the corner points of the obstacle, the variation can be described by the movement of one or a plurality of reference points on the observed edge or surface of the distributor boom. For a stationary obstacle, the relevant correlation is defined solely by the movement of the respective reference point on the distributor boom:

$$\dot{\vec{d}}_X = \dot{\vec{r}}_X = \frac{\partial \vec{r}_X}{\partial \vec{\varphi}} \cdot \vec{\omega}.$$

Evasive movement variables, in particular evasive speeds, $\vec{v}_{A,X}$ are implemented in the form of joint speeds of the boom joints in the travel command. The requirement $\dot{\vec{d}}_x = \vec{v}_{A,X}$ is followed by the equation system:

$$\begin{pmatrix} \vec{v}_{A,1} \\ \vdots \\ \vec{v}_{A,M} \end{pmatrix} = \begin{pmatrix} \frac{\partial \vec{r}_1}{\partial \vec{\varphi}} \\ \vdots \\ \frac{\partial \vec{r}_M}{\partial \vec{\varphi}} \end{pmatrix} \cdot \vec{\omega}$$

Because the distributor boom is also to carry out the movement predefined by an operator in addition to the evasive movement, this predefined movement is likewise to be taken into account when determining the travel command $\vec{\omega}$. This command is typically performed as a parameter of the movement speed of the boom tip $\overrightarrow{BBV,v_{TCP}}$, and is taken into account by way of the kinematic correlation:

$$\vec{v}_{TCP} = \frac{\partial \vec{r}_{TCP}}{\partial \vec{\varphi}} \cdot \vec{\omega}$$

It is expedient to additionally take into account the adjustment ranges of the boom joints. For this purpose, a travel command $\vec{\omega}_{gef}$ toward the center of the adjustment range can be used in the proximity of a joint limit. The kinematic correlation for this purpose is defined by way of the unit matrix $E_N$:

$$\vec{\omega}_{gef} = E_N \cdot \vec{\omega}$$

In order to combine these objectives, a combined overdetermined equation system, which cannot be exactly solved generally, in particular an, in particular combined, Jacobi matrix, or the inverse kinematics IK, is set forth:

$$\begin{pmatrix} \vec{v}_{A,1} \\ \vdots \\ \vec{v}_{A,M} \\ \vec{v}_{TCP} \\ \vec{\omega}_{gef} \end{pmatrix} \approx \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix} \cdot \vec{\omega}$$

The travel command $\vec{\omega}$ is identified from this equation system as the best solution for $\vec{\omega}$ in the context of the smallest error squares. For this purpose, the sum of the squares of the errors is minimized in the above equation. The cost functional of this optimization here is:

$$K(\vec{\omega}) = \left( \begin{pmatrix} \vec{v}_{A,1} \\ \vdots \\ \vec{v}_{A,M} \\ \vec{v}_{TCP} \\ \vec{\omega}_{gef} \end{pmatrix} - \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix} \cdot \vec{\omega} \right)^T \cdot W \cdot \left( \begin{pmatrix} \vec{v}_{A,1} \\ \vdots \\ \vec{v}_{A,M} \\ \vec{v}_{TCP} \\ \vec{\omega}_{gef} \end{pmatrix} - \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix} \cdot \vec{\omega} \right)$$

The diagonal matrix W herein contains the weights for the evasive movement variables, in particular the evasive movements, the travel command for the boom tip, and the travel commands for avoiding the joint limits, and ensures that the various tasks are prioritized.

As this is a linear correlation, this can be resolved directly by way of the general least-squares solution:

$$\vec{\omega}_{opt} = \left( \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix}^T \cdot W \cdot \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix} \right)^{-1} \cdot \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix}^T \cdot W \cdot \begin{pmatrix} \vec{v}_{A,1} \\ \vdots \\ \vec{v}_{A,M} \\ \vec{v}_{TCP} \\ \vec{\omega}_{gef} \end{pmatrix}$$

Alternatively, in particular and advantageously in this case or the present case, the minimization of the cost functional can also take place in an iterative manner, $$\frac{\partial K(\vec{\omega})}{\partial \vec{\omega}} = -2 \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix}^T \cdot W \cdot \left( \begin{pmatrix} \vec{v}_{A,1} \\ \vdots \\ \vec{v}_{A,M} \\ \vec{v}_{TCP} \\ \vec{\omega}_{gef} \end{pmatrix} - \begin{pmatrix} \frac{\partial \vec{r}_1}{\partial \vec{\varphi}} \\ \vdots \\ \frac{\partial \vec{r}_M}{\partial \vec{\varphi}} \\ \frac{\partial \vec{r}_{TCP}}{\partial \vec{\varphi}} \\ E_N \end{pmatrix} \cdot \vec{\omega} \right)$$

by way of its gradient:

$$\vec{\omega}_{opt,i+1} = \vec{\omega}_{opt,i} + \lambda \cdot \frac{\partial K(\vec{\omega})}{\partial \vec{\omega}} \Big|_{\vec{\omega} = \vec{\omega}_{opt,i}},$$

using the incrementation parameter 1 and a start value $\vec{\omega}_{opt,0}$ which in the simplest case is chosen to be simply equal to the zero vector.

In order to take account of a plurality of obstacles, the evasive movement variables, in particular the evasive speeds, are averaged so as to be weighted for a reference point on the distributor boom. The overall weight for this resultant evasive movement variable, in particular evasive speed, is determined from the individual weights, for example as a sum or maximum value.

The identified, in particular calculated, evasive movement variables, in particular evasive speeds, lead to the boom segments and/or the boom joints moving away from at least the obstacle, in this way setting a boom position or pose which moves around at least the obstacle in the best possible way.

Additionally or alternatively, the variable or adaptive weighting ensures a smooth overlap of travel command and evasive movement in such a way that the distance between the distributor boom and at least the obstacle is automatically increased if this is compatible with the travel command of the operator.

Figure 4:
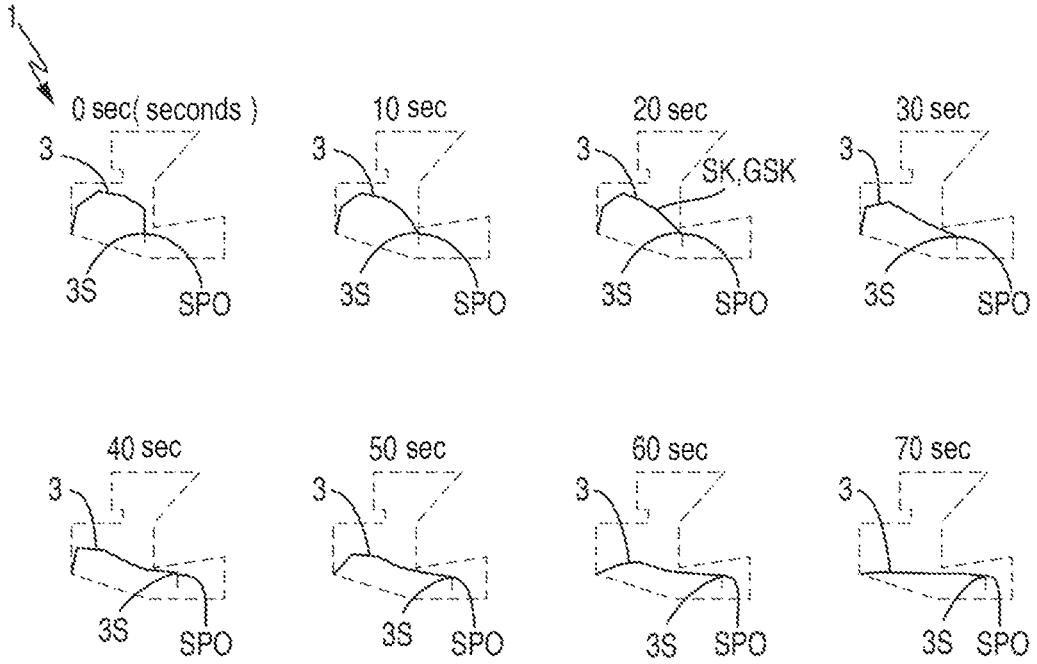
FIG. 4 schematically shows a temporal development of a situation using the system and method of FIG. 1.
Figure 5:
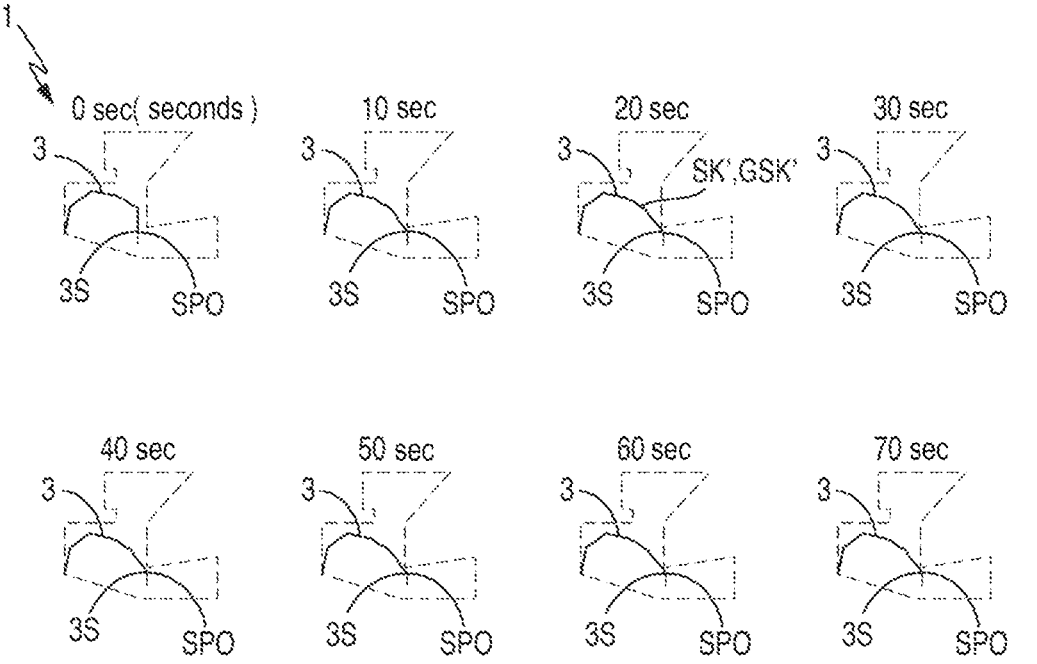
FIG. 5 schematically shows a temporal development of a situation using a system not according to the invention and a method not according to the invention.

This represents an advantage in comparison to a system not according to the invention and one not according to the invention, because the system according to the invention in the event of looming contact actively initiates evasive movements in addition to the travel command, as is shown in FIG. 4, and does not only bring the distributor boom to a standstill, as is shown in FIG. 5.

The method moreover comprises: memorizing the controlled movement of the distributor boom 3, in particular by means of the system 1, in particular the identification and control installation 2. The method comprises the following step: should the evasive movement variables AUVa-e and the operator movement variable BBV not be mutually compatible, in particular the evasive movement variables AUVa-e outweigh the operator movement variable BBV, carrying out the memorized movement in reverse, in particular by means of the system 1, in particular the identification and control installation 2.

Furthermore, the method comprises the following step: modeling the obstacle HI', in particular of a remaining part 4R of the construction material and/or thick matter pumping device 4 having the distributor boom 3, with a shape HIM' larger than a real shape HIT' of the obstacle HI', in particular by means of smoothing and/or flattening transitions of the real shape HIT', in particular by means of the system 1, in particular the identification and control installation 2. Step a)

comprises: identifying at least one of the distance variables ABVa-e in relation to the modeled obstacle HI'.

Moreover, FIGS. 1 to 4 show the method according to the invention for distributing construction material and/or thick matter BDS by means of the construction material and/or thick matter pumping device. The construction material and/or thick matter pumping device 4 has the adjustable distributor boom 3. The distributor boom 3 has a conveying line 9 for conveying construction material and/or thick matter BDS. The method comprises the method for controlling the movement of the distributor boom 3 as mentioned above. The method comprises the following step: conveying construction material and/or thick matter BDS during the movement.

As highlighted in the exemplary embodiments shown and discussed above, the invention provides an advantageous method and an advantageous system, in particular each, for controlling a movement of an adjustable distributor boom, which has in each case improved characteristics, and an advantageous method for distributing construction material and/or thick matter by means of a construction material and/or thick matter pumping device comprising an adjustable distributor boom having such a method for controlling a movement of an adjustable distributor boom.

The invention claimed is:

1. A method for controlling movement of an adjustable distributor boom, wherein the adjustable distributor boom has adjustable boom components, wherein at least one same tip position of a boom tip of the adjustable distributor boom is achievable by different position combinations of the adjustable boom components, the method comprising the steps of:

a) calculating vectorial distance variables for a plurality of boom elements of the adjustable distributor boom in relation to at least one obstacle for the plurality of boom elements, wherein the vectorial distance variables are momentary actual vectorial distance variables;

b) calculating vectorial evasive movement variables for a plurality of the boom components based on the calculated vectorial distance variables, wherein the vectorial evasive movement variables are momentary target directions and momentary target speeds of target evasive movements of the plurality of the boom components, and wherein the vectorial evasive movement variables are counter to the vectorial distance variables and lead away from the at least one obstacle; and c) controlling the movement as a function of the calculated vectorial evasive movement variables and a vectorial operator movement variable for a tip position of the boom tip, wherein the controlling comprises weighting of the calculated vectorial evasive movement variables and the vectorial operator movement variable via respective variable weighting factors depending on values of the vectorial distance variables, and wherein the vectorial operator movement variable is a momentary target direction and a momentary target speed of a target movement of the boom tip;

wherein the method further comprises the steps of:

modeling the obstacle with a shape larger than a real shape of the obstacle to obtain a modeled obstacle, wherein the modeling comprises an introduction of flanks and/or ramps; and wherein step a) comprises:

calculating at least one of the vectorial distance variables in relation to the modeled obstacle;

wherein the method carries out steps a), b) and c) anew multiple times.

2. The method as claimed in claim 1, wherein a plurality of adjustable boom joints of the adjustable distributor boom are identical.

3. The method as claimed in claim 1, the method further comprising:

memorizing the controlled movement of the adjustable distributor boom; and should the vectorial evasive movement variables outweigh the vectorial operator movement variable, carrying out the memorized movement in reverse.

4. The method as claimed in claim 1, wherein the adjustable distributor boom has a plurality of adjustable boom joints, wherein the same tip position is achievable by different joint position combinations of the plurality of adjustable boom joints, and wherein the plurality of adjustable boom joints have different adjustment ranges;

wherein step c) comprises:

controlling movements of the plurality of adjustable boom joints as a function of the vectorial evasive movement variables and the vectorial operator movement variable, while factoring into account the different adjustment ranges.

5. The method as claimed in claim 4, wherein step c) comprises:

controlling the movement by way of weighted and/or modular inverse kinematics, wherein the vectorial evasive movement variables and the vectorial operator movement variable are input variables.

6. The method as claimed in claim 1, wherein step c) comprises:

controlling the movement by way of weighted inverse kinematics, wherein the vectorial evasive movement variables and the vectorial operator movement variable are input variables.

7. A method for distributing construction material and/or thick matter by a construction material and/or thick matter pumping device, wherein the construction material and/or thick matter pumping device has an adjustable distributor boom with adjustable boom components, and wherein the adjustable distributor boom has a conveying line for conveying construction material and/or thick matter;

the method comprising:

a) calculating vectorial distance variables for a plurality of boom elements of the adjustable distributor boom in relation to at least one obstacle for the plurality of boom elements, wherein the vectorial distance variables are momentary actual vectorial distance variables;

b) calculating vectorial evasive movement variables for a plurality of the boom components based on the calculated vectorial distance variables, wherein the vectorial evasive movement variables are momentary target directions and momentary target speeds of target evasive movements of the plurality of the boom components, and wherein the vectorial evasive movement variables are counter to the vectorial distance variables and lead away from the at least one obstacle;

c) controlling a movement of the adjustable distributor boom as a function of the calculated vectorial evasive movement variables and a vectorial operator movement variable for a tip position of a boom tip of the adjustable distributor boom, wherein the controlling comprises weighting of the calculated vectorial evasive movement variables and the vectorial operator movement variable via respective variable weighting factors depending on values of the vectorial distance variables, and wherein the vectorial operator movement variable is a momentary target direction and a momentary target speed of a target movement of the boom tip; and conveying construction material and/or thick matter during the controlling of the movement, wherein the construction material is mortar, cement, screed, concrete and/or render, and/or the thick matter is mud;

wherein the method further comprises the steps of:

modeling the obstacle with a shape larger than a real shape of the obstacle to obtain a modeled obstacle, wherein the modeling comprises an introduction of flanks and/or ramps; and wherein step a) comprises:

calculating at least one of the vectorial distance variables in relation to the modeled obstacle;

wherein the method carries out steps a), b) and c) anew multiple times.

8. A system for controlling movement of an adjustable distributor boom, wherein the adjustable distributor boom has adjustable boom components, and wherein at least one same tip position of a boom tip of the adjustable distributor boom is achievable by different position combinations of the adjustable boom components, the system comprising:

an identification and control installation;

wherein the identification and control installation is configured to:

calculate vectorial distance variables for a plurality of boom elements of the adjustable distributor boom in relation to at least one obstacle for the plurality of boom elements, wherein the vectorial distance variables are momentary actual vectorial distance variables;

calculate vectorial evasive movement variables for a plurality of the boom components based on the calculated vectorial distance variables, wherein the vectorial evasive movement variables are momentary target directions and momentary target speeds of target evasive movements of the plurality of the boom components, and wherein the vectorial evasive movement variables are counter to the vectorial distance variables and lead away from the at least one obstacle; and control the movement as a function of the calculated vectorial evasive movement variables and a vectorial operator movement variable for a tip position of the boom tip, wherein the control comprises weighting of the calculated vectorial evasive movement variables and the vectorial operator movement variable via respective variable weighting factors depending on values of the vectorial distance variables, and wherein the vectorial operator movement variable is a momentary target direction and a momentary target speed of a target movement of the boom tip;

wherein the identification and control installation is further configured to:

model the obstacle with a shape larger than a real shape of the obstacle to obtain a modeled obstacle, wherein the modeling comprises an introduction of flanks and/or ramps; and calculate at least one of the vectorial distance variables in relation to the modeled obstacle.

* * * * *